US009908674B2

(12) United States Patent
Bergkamp

(10) Patent No.: US 9,908,674 B2
(45) Date of Patent: Mar. 6, 2018

(54) BALING SYSTEM BUCKLES FOR SECURING A BALE

(71) Applicant: Alan R. Bergkamp, Hutchinson, KS (US)

(72) Inventor: Alan R. Bergkamp, Hutchinson, KS (US)

(73) Assignee: Accent Packaging, Inc., Tomball, TX (US)

( * ) Notice: Subject to any disclaimer, the term of this patent is extended or adjusted under 35 U.S.C. 154(b) by 0 days.

(21) Appl. No.: 15/290,259

(22) Filed: Oct. 11, 2016

(65) Prior Publication Data

US 2017/0190487 A1 Jul. 6, 2017

Related U.S. Application Data

(60) Provisional application No. 62/241,480, filed on Oct. 14, 2015.

(51) Int. Cl.

| | |
|---|---|
| ***B65D 63/16*** | (2006.01) |
| ***B65D 63/10*** | (2006.01) |
| ***B65B 13/34*** | (2006.01) |

(52) U.S. Cl.

CPC ..... *B65D 63/1018* (2013.01); *B65B 13/34* (2013.01)

(58) Field of Classification Search

CPC B65D 63/1038; B65D 63/1018; B65B 13/34; F16G 11/046; Y10T 24/3969; Y10T 24/3971; Y10T 24/3973; Y10T 24/3996

See application file for complete search history.

(56) References Cited

U.S. PATENT DOCUMENTS

| | | | |
|---|---|---|---|
| 134,052 | A | 12/1872 | Gurley |
| 903,128 | A | 11/1908 | Cary |
| 6,230,369 | B1 | 5/2001 | Steadman |
| 6,389,653 | B1 | 5/2002 | Matoba |
| 6,406,242 | B1 | 6/2002 | Gordon |

(Continued)

FOREIGN PATENT DOCUMENTS

| | | |
|---|---|---|
| EP | 1 186 817 A2 | 3/2002 |
| FR | 1527841 | 4/1968 |

(Continued)

*Primary Examiner* — Robert Sandy
(74) *Attorney, Agent, or Firm* — Ira Domnitz

(57) ABSTRACT

A buckle for use in securing a band around a bale of material includes a socket member having an aperture formed therein and a wedge member having a portion shaped to maximize friction with a band and a rounded portion opposite the portion shaped to maximize friction with a band. The wedge member is initially connected to the socket member by at least one frangible link in an initial orientation having the rounded portion oriented toward the aperture in the socket member and the portion shaped to maximize friction with a band oriented away from the aperture. The buckle is used in a automated method wherein both ends of a band extending around a bale are clamped to the wedge member, the wedge member is rotated to a final position wherein the portion shaped to maximize friction with a band of the—wedge member is oriented toward the aperture and urged into the aperture, thereby capturing, both ends of the band between the portion shaped to maximize friction with a band of the wedge member and the socket member.

9 Claims, 4 Drawing Sheets

(56) References Cited

U.S. PATENT DOCUMENTS

| | | | | |
|---|---|---|---|---|
| 8,381,364 | B2 | 2/2013 | Kube et al. | |
| 2004/0187271 | A1 | 9/2004 | Mikkelsen | |
| 2012/0291230 | A1 | 11/2012 | Hida | |
| 2015/0266636 | A1 * | 9/2015 | Zantout ..... | B65D 63/1018 24/16 R |

FOREIGN PATENT DOCUMENTS

| | | | |
|---|---|---|---|
| GB | 1 427 051 | | 3/1976 |
| JP | 2001354261 | A * | 12/2001 |
| RS | 20140645 | | 11/2014 |
| WO | 2014177770 | | 11/2014 |
| WO | 2015148084 | | 10/2015 |

* cited by examiner

BALING SYSTEM BUCKLES FOR SECURING A BALE

CROSS-REFERENCE TO RELATED APPLICATIONS

This application claims priority to U.S. provisional patent application 62/241,480, filed Oct. 14, 2015, which is incorporated by reference herein in its entirety.

STATEMENT REGARDING FEDERALLY SPONSORED RESEARCH

Not applicable.

BACKGROUND

This invention relates generally to material balers and in particular to a system for attaching a band around a bale and to a buckle for use with that system.

Baled materials or commodities, such as trash, recyclables, cotton, and rectangular bales of hay (commonly referred to as square bales) are traditionally bound together with twine, the twine being looped tightly around the bale by a mechanical baler during the baling process and the ends tied together by a subassembly of the baler known as a knotter.

In order to save on transportation and storage costs, it is sometimes desirable to pack the bales as densely as possible. This is particularly true of large bales which are handled using mechanized equipment which is inherently capable of handling the increased weight of denser bales. With the previous technology, the amount of material that can be packed into a bale is limited by at least the tensile strength of the twine and by the strength of the knots. Twine may also have a relatively high rate of elasticity which limits the density of the bale due to potential stretching issues. What is needed is a higher strength baling system which can effectively contain a denser bale without breaking or stretching excessively. The present invention solves such an issue.

SUMMARY

In some embodiments of the present invention, the baling system of the present invention utilizes high strength plastic straps or bands in place of traditional baler twine for securing a bale as known in the art. Each band is looped around a bale in a similar manner to that currently used for twine. The ends of each band are then secured together using a specialized buckle.

In some embodiments of the present invention, the buckles are automatically attached using respective fastening mechanisms which replace the knotters of the baler. Because the fastened band and buckle assembly is stronger than knotted twine, more material can be packed into each bale, thereby producing a denser and heavier bale. The bands also have a lower rate of elasticity than twine and prevent the bales from expanding.

In some embodiments, the buckle generally includes a rectangular socket member and a wedge member. In some embodiment, the wedge member is initially connected to the socket member by at least one frangible link. In some embodiments the initial position of the wedge member relative to the socket member is inverted from its final position when securing a band. In some embodiments the socket member includes a rectangular aperture with a pair of sidewalls and a pair of end walls. In some embodiments, the end walls include teeth or serrations which interlock with mating structure on the wedge member.

In some embodiments, the wedge member includes a tapered portion, or portion shaped to maximize friction with a band, and an opposite rounded portion. In some embodiments, the tapered portion, or portion shaped to maximize friction with a band, is initially positioned in an opposed orientation from the socket member, with the rounded portion oriented toward the socket member. In some embodiments, the tapered portion, or portion shaped to maximize friction with a band, has end walls and angled sidewalls. The end walls have serrations which interlock with the serrations of the socket member. In some embodiments of the present invention the wedge member has a portion shaped to maximize friction with a band.

For use in some embodiments, the ends of a band encircling a bale are threaded through the aperture in the socket member and then both ends are clamped against one of the sidewalls of the wedge member by the fastening mechanism. The fastening mechanism then begins to rotate the wedge member, shearing the frangible links while keeping ends of the band clamped against the wedge member. In some embodiments, the wedge member can rotate 180 degrees into a final orientation substantially inverted from the original position such that the tapered portion, or portion shaped to maximize friction with a band, is oriented toward the socket member and both ends of the band are wrapped around the rounded portion of the wedge member.

In several embodiments, the fastening mechanism also pushes the tapered portion or portion shaped to maximize friction with a band, of the wedge member into the aperture of the socket member, thereby capturing the band between both sidewalls of the wedge member and the respective internal sidewalls of the socket member. Simultaneously, the serrations of the wedge member interlock with the serrations of the socket member, prevention the wedge member from being withdrawn from the socket member.

In several embodiments of the present invention, the present invention is a buckle for use in securing a band around a bale of material, the buckle comprising: a socket member having an aperture formed therein; and a wedge member having a tapered, or portion shaped to maximize friction with a band, portion and a rounded portion opposite said tapered portion, or portion shaped to maximize friction with a band, wherein said wedge member is initially connected to said socket member by at least one frangible link in an initial orientation having said rounded portion oriented toward said aperture in said socket member and said tapered portion, or portion shaped to maximize friction with a band, oriented away from said aperture.

In several embodiments, rotation of said wedge member out of the initial orientation relative to said socket member causes said frangible links to fracture.

In several embodiments said tapered, or portion shaped to maximize friction with a band, portion of said wedge member is insertable into said aperture in said socket member.

In several embodiments said wedge member includes; first and second end walls, said aperture includes respective first and second internal end walls, and said end walls of said wedge member each include serrations interlockable with matching serrations on said internal end walls of said aperture, said serrations inhibiting removal of said tapered portion, or portion shaped to maximize friction with a band, of said wedge member from said aperture once inserted therein.

In several embodiments, the present invention is a method for clamping a band around a bale of material, the method comprising the steps of: providing a buckle having: a socket member having an aperture formed therein; and a wedge member having a tapered portion, or portion shaped to maximize friction with a band, and a rounded portion opposite the tapered portion, or portion shaped to maximize friction with a band; wherein said wedge member is initially connected to the socket member by at least one frangible link in an initial orientation having the rounded portion oriented toward the aperture in the socket member and the tapered portion, or portion shaped to maximize friction with a band, oriented away from the aperture; clamping both ends of a band extending around a bale to the wedge member; rotating the wedge member out of the initial position toward a final position wherein the tapered portion, or portion shaped to maximize friction with a band, of the wedge member is oriented toward the aperture in the socket member; and urging the tapered portion, or portion shaped to maximize friction with a band, of the wedge member into the aperture in the socket member and capturing both ends of the band between the tapered portion or portion shaped to maximize friction with a band, of the wedge member and the socket member.

In several embodiments, during said rotating step, both ends of the band are wrapped around the rounded portion of the wedge member. In several embodiments, the wedge member includes; first and second sidewalls, the aperture includes respective first and second internal sidewalls, and wherein, during said insertion step, both ends of the band are captured between both sidewalls of the wedge and the respective internal sidewalls of the aperture.

BRIEF DESCRIPTION OF THE DRAWINGS

For a more complete understanding of the present disclosure and the advantages thereof, reference is now made to the following descriptions to be taken in conjunction with the accompanying drawings describing specific embodiments of the disclosure, wherein.

DETAILED DESCRIPTION

Figure 1:
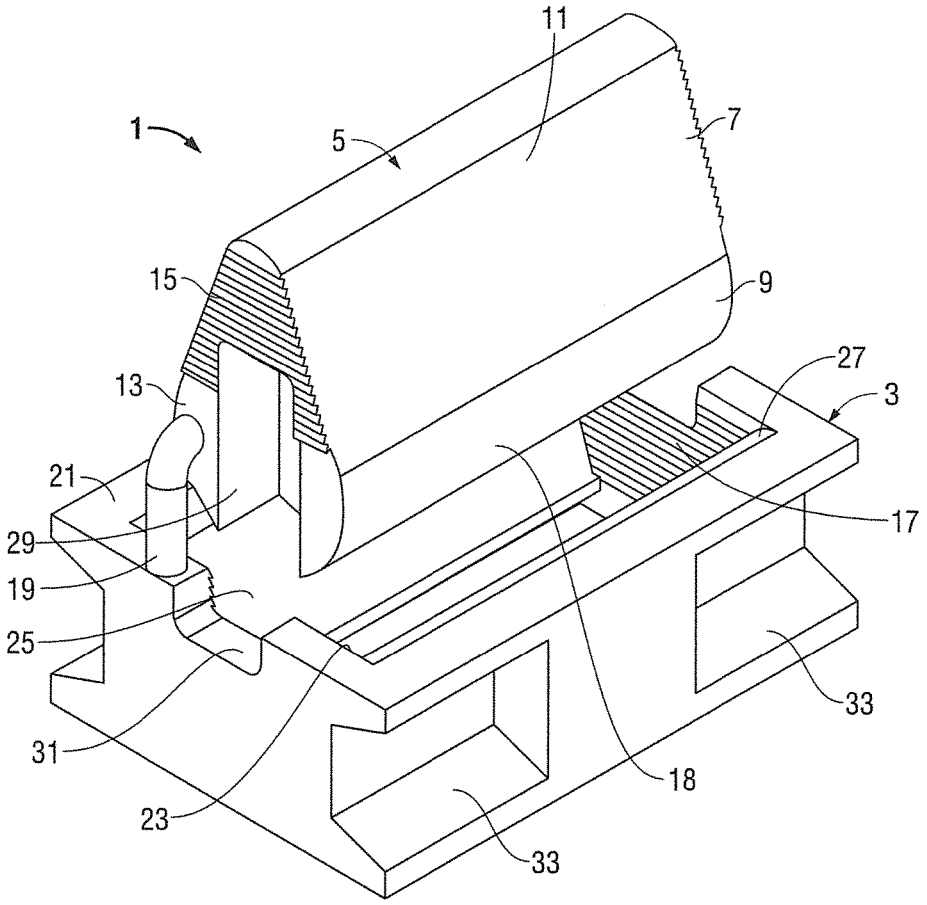
FIG. 1 is a perspective view of a buckle for use with the baling system of the present invention.

One or more illustrative embodiments incorporating the invention disclosed herein are presented below. Applicant has created a revolutionary baling buckle.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not, unless specifically stated in this specification or if the incorporation is necessary for maintaining validity.

Certain terms are used in the following description and claims to refer to particular system components. As one skilled in the art will appreciate, different persons may refer to a component by different names. This document does not intend to distinguish between components that differ in name but not function. The drawing figures are not necessarily to scale. Certain features of the invention may be shown exaggerated in scale or in somewhat schematic form, and some details of conventional elements may not be shown, all in the interest of clarity and conciseness.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 2:
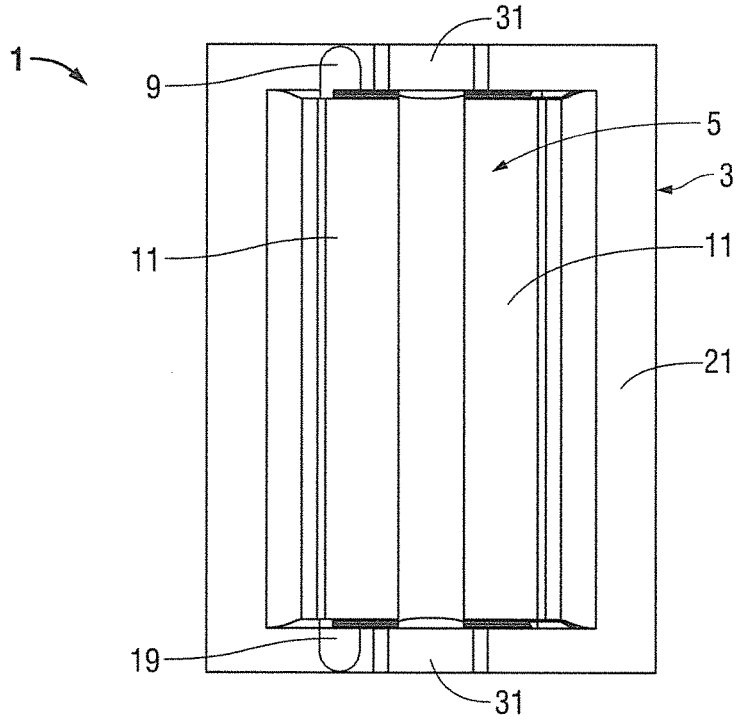
FIG. 2 is a top plan view of the buckle of FIG. 1.
Figure 3:
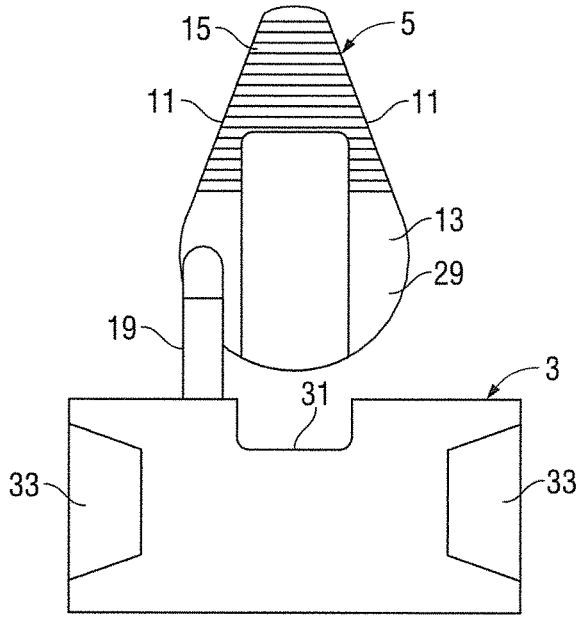
FIG. 3 is left side elevational view of the buckle of FIG. 1.

Referring to the drawings in more detail, and in particular to FIGS. 1-3, the reference number 1 generally designates the inventive buckle for use with a baling system of the present invention as known in the art. In several embodiments the buckle 1 is for use in securing a band B (see FIGS. 4-7) around a bale of material (not shown). In several embodiments, buckle 1 may be comprised of one solid molded piece. In several embodiments, buckle 1 may be of high strength plastic or other comparable material for a baling system.

As shown in FIGS. 1-3, in several embodiments, the portion of the band B below the buckle 1 can extend substantially around the bale but is shown fragmentary in the views provided. The buckle 1 is fastened to the band B by an automatic fastening mechanism (as known in the art). In several embodiments, the buckle 1 includes a generally rectangular socket member 3 and a wedge member 5. Other three dimensional shapes can be utilized for socket member 3 and or wedge member 5. Buckle 1 can be constructed with burnable plastic. Buckle 1 can be constructed of a single molded piece material or of multiple molded piece materials.

As shown in FIGS. 1-3, in several embodiments, the wedge member 5 includes a tapered portion, or portion shaped to maximize friction with a band, 7 and an opposite rounded portion 9. In several embodiments, the tapered portion, or portion shaped to maximize friction with a band, 7 is initially positioned in an opposed orientation from the socket member 3, with the rounded portion 9 oriented toward the socket member 3. In several embodiments, the tapered portion or portion shaped to maximize friction with a band, —has angled or sloped sidewalls 11 and end walls 13. In several embodiments, the end walls 13 include serrations 15 which interlock with the serrations 17 of the socket member 3. The rounded portion 9 has a rounded outer surface 18. In several embodiments outer surface 18 is preferably constructed in a three dimensional geometric pattern designed to maximize friction with a banding material.

As shown in FIGS. 1-3, the wedge member 5 is initially connected to the socket member 3 by a pair of frangible links 19 which each extend between a respective end wall 13 of the wedge member 5 and a top surface 21 of the socket member 3. The socket member 3 includes an aperture 23 with a pair of internal sidewalls 25 and a pair of internal end walls 27. The end walls 27 may include the serrations 17 which interlock with the respective serrations 15 on the end walls 13 of the wedge member 5.

As shown in FIGS. 1-3, in several embodiments of the present invention, the wedge member 5 further includes a pair of generally rectangular indentations 29 which extend into the wedge member 5 from the respective end walls 13. Indentions 29 maybe of variant geometric shapes as is known in the art. In several embodiments, the indentations 29 extend into the rounded portion 9 of the wedge member 5 and intersect with the rounded outer surface 18 such that the indentations 29 are open at the rounded outer surface 18. See FIG. 1.

In several embodiments, notches 31 are formed in the top surface 21 of the socket member 3 in register with the indentations 29. In several embodiments, notches 31 are substantially rectangular in shape, but can be of other variant shapes. In several embodiments, indentations 29 are for engagement of the wedge member 5 by elements of the fastening mechanism (as known in the art). In several embodiments, socket member 3 also includes indentations 33 for engagement by elements of the fastening mechanism to hold the buckle 1 in position while the band B is being automatically secured with the buckle 1.

Figure 4:
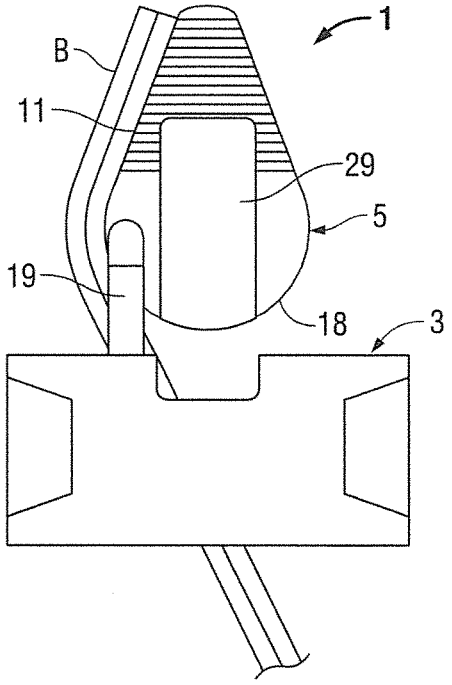
FIG. 4 is a view similar to FIG. 3 showing both ends of a band threaded through a socket member of the buckle of FIG. 1 and in a clamped position against a wedge member of the buckle, shown with the wedge member in an initial orientation.

Referring to FIGS. 4-7, and in several embodiments, operation of the buckle 3 will now be described without including specific details of the fastening mechanism. In use, in several embodiments, as shown in FIG. 4, the ends of a band B encircling a bale of material (not shown) are threaded through the aperture 23 in the socket member 3 and then both clamped against one of the sidewalls 11 of the wedge member 5 by the fastening mechanism (as known in the art). (See also FIG. 1). The fastening mechanism, as is known in the art, then begins to rotate the wedge member 5 out of its initial position, shearing the frangible links 19 while keeping the ends of the band B clamped against the wedge member 3.

Figure 5:
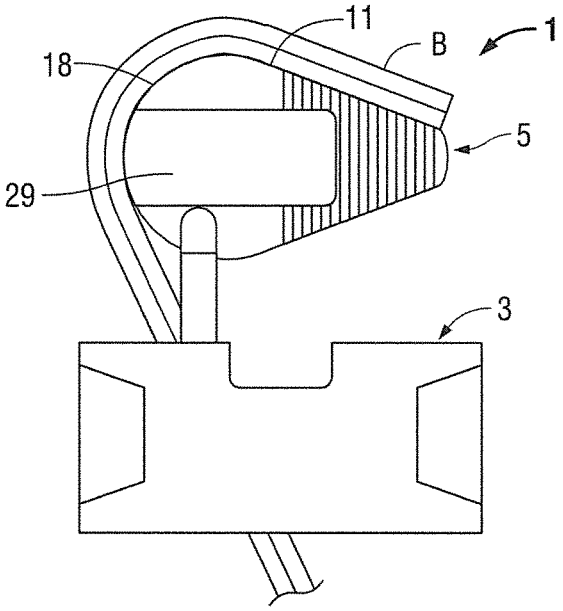
FIG. 5 is a view similar to FIG. 4 shown with the wedge member rotated substantially 90 degrees from the initial orientation.

FIG. 5 shows, in several embodiments, wedge member 5 rotated substantially 90 degrees from its initial position. Wedge member 5 is actually rotated to and past 90 degrees in most operations.

Figure 6:
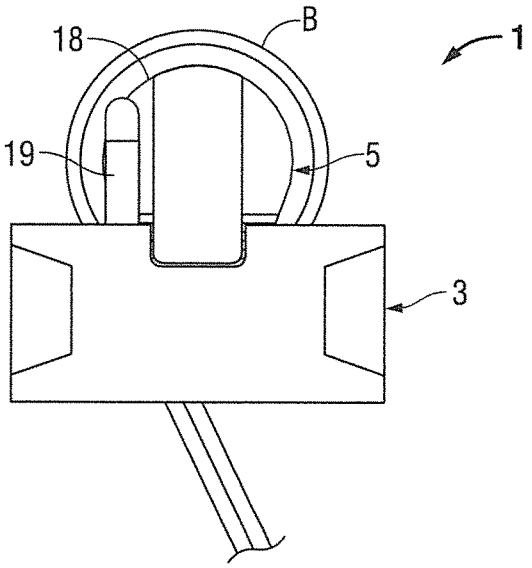
FIG. 6 is a view similar to FIG. 4 shown with the wedge member in a final orientation rotated substantially 180 degrees from the initial orientation and pushed downwardly into the socket member.
Figure 7:
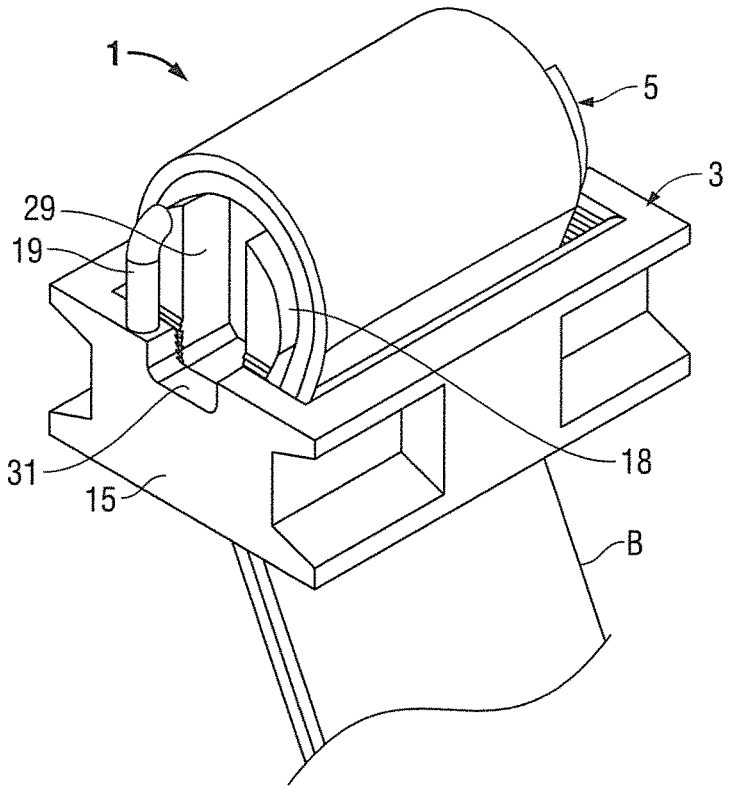
FIG. 7 is a perspective view of the buckle with the wedge member in the final orientation.

In several embodiments, wedge member 5 is rotated 180 degrees into a final orientation shown in FIGS. 6 and 7. Wedge member 5, in some embodiments need not rotate 180 degrees in final orientation and can deviate significantly from 180 degree rotation.

As illustrated in FIG. 6, in some embodiments, the final orientation is inverted from the initial position such that the tapered portion, or portion shaped to maximize friction with a band, 7 is oriented toward the socket member 3 and both ends of the band B are wrapped around the outer surface 18 of the rounded portion 9 of the wedge member 5.

In several embodiments, and as shown in end result, the fastening mechanism also pushes the tapered portion, or portion shaped to maximize friction with a band, 7 of the wedge member 5 downwardly into the aperture 23 of the socket member 3, thereby capturing the band B between both sidewalls 11 of the wedge member 5 and the respective internal sidewalls 25 of the socket member 3. Rotation and downward motion of the wedge member 5 are preferably carried out in a single motion, however, in several embodiments multiple movements can occur. Simultaneously, the serrations 15 of the wedge member 5 interlock with the serrations 17 of the socket member 3, preventing the wedge member 5 from being withdrawn from the socket member 3.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements, or to a pair of elements, is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

As used herein, references to the "ends" of a band are intended to cover the portions of a band which extend past the loop of band encircling a bale, not necessarily to free ends or to the end surfaces of a cut band. References to clamping the ends of a band are intended to cover both clamping the free ends of a cut section of band and clamping the portion of a continuous band that will become a free end after cutting of the band, or any combination thereof. For example, if banding material is being fed off of a roll and looped around a forming bale, it is foreseen that a portion of the band proximate the free end could be clamped to a portion of the band coming off of the roll that will become the other free end of the band after the band is cut.

While preferred embodiments have been shown and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied.

What is claimed is the following:

1. A buckle for use in securing a band around a bale of material, the buckle comprising:

a socket member having an aperture formed therein; and a wedge member having a portion shaped to maximize friction with the band and a rounded portion opposite said portion shaped to maximize friction with the band; wherein said wedge member is initially connected to said socket member by at least one frangible link in an initial orientation having said rounded portion oriented toward said aperture in said socket member and said portion shaped to maximize friction with the band oriented away from said aperture, and wherein rotation of said wedge member out of the initial orientation relative to said socket member causes said frangible links to fracture.

2. The buckle as in claim 1 wherein said portion shaped to maximize friction with the band of said wedge member is insertable into said aperture in said socket member.

3. The buckle as in claim 2 wherein said wedge member includes first and second end walls, said aperture includes respective first and second internal end walls, and said end walls of said wedge member each include serrations interlockable with matching serrations on said internal end walls of said aperture, said serrations inhibiting removal of said portion shaped to maximize friction with the band of said wedge member from said aperture once inserted therein.

4. A single piece buckle for use in securing a band around a bale of material, the single piece buckle comprising:

a socket member having an aperture formed therein; and a wedge member having a portion shaped to maximize friction with the band and a rounded portion opposite said portion shaped to maximize friction with the band; wherein said wedge member is initially connected to said socket member by at least one frangible link in an initial orientation having said rounded portion oriented toward said aperture in said socket member and said portion shaped to maximize friction with the band oriented away from said aperture, wherein rotation of said wedge member out of the initial orientation relative to said socket member causes said frangible links to fracture.

5. The single piece buckle as in claim 4 wherein said portion shaped to maximize friction with the band of said wedge member is insertable into said aperture in said socket member.

6. The single piece buckle as in claim 5 wherein said wedge member includes first and second end walls, said aperture includes respective first and second internal end walls, and said end walls of said wedge member each include serrations interlockable with matching serrations on said internal end walls of said aperture, said serrations inhibiting removal of said portion shaped to maximize friction with the band of said wedge member from said aperture once inserted therein.

7. A method for clamping a band around a bale of material, the method comprising the steps of:

providing a buckle having:

a socket member having an aperture formed therein; and a wedge member having a portion shaped to maximize friction with the band and a rounded portion opposite the portion shaped to maximize friction with the band; wherein said wedge member is initially connected to the socket member by at least one frangible link in an initial orientation having the rounded portion oriented toward the aperture in the socket member and the portion shaped to maximize friction with the band oriented away from the aperture;

clamping both ends of the band extending around a bale to the wedge member; rotating the wedge member out of the initial position toward a final position wherein the portion shaped to maximize friction with the band of the wedge member is oriented toward the aperture in the socket member;

urging the portion shaped to maximize friction with the band of the wedge member into the aperture in the socket member and capturing both ends of the band between the portion shaped to maximize friction with the band of the wedge member and the socket member; and rotating said wedge member out of the initial orientation relative to said socket member causing said frangible links to fracture.

8. The method as in claim 7 wherein, during said rotating step, both ends of the band are wrapped around the rounded portion of the wedge member.

9. The method as in claim 8 wherein the wedge member includes first and second sidewalls, the aperture includes respective first and second internal sidewalls, and wherein, during the band insertion step, both ends of the band are captured between both sidewalls of the wedge and the respective internal sidewalls of the aperture.

* * * * *